US005526749A

United States Patent [19]

Teetzel

[11] Patent Number: 5,526,749

[45] Date of Patent: Jun. 18, 1996

[54] LASER DETONATED PROJECTILE APPARATUS

[76] Inventor: James W. Teetzel, 151 Lafayette Rd., Portsmouth, N.H. 03801

[21] Appl. No.: 488,648

[22] Filed: Jun. 7, 1995

Related U.S. Application Data

[63] Continuation-in-part of Ser. No. 349,375, Dec. 5, 1994, which is a continuation-in-part of Ser. No. 303,860, Sep. 9, 1994, which is a continuation-in-part of Ser. No. 200,204, Feb. 23, 1994, which is a continuation-in-part of Ser. No. 89,089, Jul. 12, 1993, Pat. No. 5,425,299, which is a continuation-in-part of Ser. No. 73,766, Jun. 8, 1993, Pat. No. 5,355,608.

[51] Int. Cl.[6] ..... F42C 13/02

[52] U.S. Cl. ..... 102/213; 102/201; 102/207; 102/244

[58] Field of Search ..... 102/207, 213, 102/201, 472, 244; 42/103

[56] References Cited

U.S. PATENT DOCUMENTS 3,641,938 2/1972 Gawlick et al. ..... 102/207

5,196,644 3/1993 Knight et al. ..... 102/213

FOREIGN PATENT DOCUMENTS 2545598 11/1984 France ..... 102/201

3123339 12/1982 Germany ..... 102/201

3935648 5/1991 Germany ..... 102/213

*Primary Examiner*—Stephen M. Johnson

*Attorney, Agent, or Firm*—William B. Ritchie

[57] ABSTRACT

An intelligent projectile that can be detonated at a predetermined range via a wide angle infrared laser. The projectile is fitted with a detector that is sensitive to the frequency of a wide angle laser beam that is attached to the weapon. Using the range obtained by the range finder, the wide angle laser beam is fired when the projectile is in proper position relative to the target. To prevent the projectile from exploding prior to its being fired, a series of batteries is held in a track via compressions springs. The springs must be compressed via centrifugal force due to the projectile spinning as a resulting of rifling in the weapon. Once, sufficient centrifugal force is reached, the batteries will slide into a "contact" position so that the projectile can be detonated. The apparatus fits within standard 40 mm shell casings and can be fired by conventional grenade launching weapons.

6 Claims, 4 Drawing Sheets

(SWITCH INACTIVE)

(SWITCH ACTIVE)

(SWITCH INACTIVE)

(SWITCH ACTIVE)

LASER DETONATED PROJECTILE APPARATUS

This application is a continuation-in-part of U.S. patent application Ser. No. 08/349,375, filed Dec. 5, 1994, which is a continuation-in-part of U.S. patent application Ser. No. 08/303,860, filed Sep. 9, 1994 which is a continuation-in-part of U.S. Pat. application Ser. No. 08/200,204, filed Feb. 23, 1994 which is a continuation-in-part of U.S. Pat. application Ser. No. 08/089,889, filed Jul. 12, 1993, now U.S. Pat. No. 5,425,299 which is a continuation-in-part of U.S. Pat. application Ser. No. 08/073,766, filed Jun. 8, 1993, now issued as U.S. Pat. No. 5,355,608.

BACKGROUND OF THE INVENTION

1. Field of the Invention

The invention relates to the use of lasers on small projectiles to improve accuracy by measuring the distance to the target and controlling detonation timing.

2. Description of the Related Art

It is well known that even skilled marksmen have been unable to hit a target as close as 7 meters when attempting to draw a handgun and fire at speed. In target shooting, the shooter must obtain the proper stance by carefully positioning the feet and the "free" hand to find the most stable condition, producing no muscular strain that will adversely effect the accuracy of the shot. Most importantly, the shooter must be able to obtain an identical position each time the weapon is fired to achieve the greatest accuracy. As the whole upper torso moves during each breath, breath control plays a vital role in the process. Since there can be no body movement at the time the trigger is fired, obviously the act of breathing must be stopped during the time the weapon is aimed and fired.

Sight picture and aim are critical if the shooter is to fire the most accurate shot or series of shots. When a mechanical pistol sight is properly aligned, the top of the front sight should be level with the top of the rear sight, with an equal amount of light on either side of the front sight. Using this sight picture requires that the shooter focus his shooting eye so that the sights are in focus and the target is out of focus. Added to the difficulty, the trigger, all of the above must be maintained while the trigger is released using direct, even pressure to keep the barrel of the gun pointing at the target. These skills require tremendous practice, with each shot fired needing the utmost concentration if the shooter is to obtain maximum accuracy.

It is clear that the recommended methods of achieving maximum shooting accuracy useful for target shooting must be severely modified when a handgun is used in a law enforcement situation. While the degree of accuracy necessary for target shooting and the distances are substantially lower, accuracy is still vital. Law enforcement officials are instructed to fire only as a last resort, cognizant of the fact that their intended target will most likely be killed. Shooting to wound occurs only in the movies. Law enforcement officers typically use higher caliber handguns, mostly 9 mm, which are designed to immobilize with a single shot if that shot strikes a vital area. Given the inherent inaccuracies in the shooting process itself, exacerbated by the stress and fear of the police officer in what may be a life threatening situation for him/her, the exact location of the bullet, where millimeters can mean the difference between death and survival, cannot be known a priori by even the most skilled marksman.

Mechanical sights have limited value in many situations where an officer must quickly draw his gun, perhaps while moving, and fire at a close target without sufficient time to properly obtain a sight picture. Under these circumstances, instinctive aiming, that is, not using the sights but rather feeling where the gun barrel is pointing using the positioning of the hand holding the gun, is the preferred method. While this method, akin to the typical television cowboy shootouts, can be reasonably effective at short distances, obviously large errors in aiming are easily introduced, especially when the officer must frequently fire his/her weapon from a different hand position that has been used for practice. For example, bullet proof shields are used to protect the officer from being fired upon such as in a riot situation. In those circumstance, the officer must reach around his/her shield or other barricade and instinctively aim and fire his/her gun with the handgun in a very different orientation that would be experienced if fired from a standing, "drawn from a holster" position. Small changes in barrel orientation due to the sight radius of the typical law enforcement handgun can produce substantial errors relative to the target. Accurate instinctive shooting is not considered practical beyond 20 feet for the average shooter.

The same problems face a soldier in a combat situation. While a rifle is inherently more accurate that a handgun, the stress of combat, the need to fire rapidly but accurately in order to survive is sufficient to introduce substantial errors into the sighting process. These problems are further exacerbated by the fact that most military personnel do not have sufficient practice time with their weapon to develop a high proficiency, particularly in combat simulated situations.

An additional problem encountered in the military situation is the need for a sighting system that can be easily moved from one weapon to another. As warfare increases in sophistication, the need for more versatile armament increases correspondingly. Ideally, an operator should be able to quickly and confidently move the sighting system from one weapon to another without needing any field adjustments.

Laser technology has been previously introduced as a solution to the problem of accurately and rapidly sighting a handgun on an intended target. The typical laser sight is mounted on the top on the handgun or on the bottom. The laser sight when properly aligned, places a red light dot on the target where the bullet will strike if the gun is fired. Using this type of sight, enables the law officer to rapidly, instinctively, properly position the weapon and be certain of his/her intended target. Using a laser sight enables accurate shots to be fired at distances of more than 50 feet, sufficient for most combat law enforcement situations requiring the use of handguns.

Laser sights have proven their worth for sighting weapons having substantially flat trajectories over extended distances such as the M-16 or for powerful handguns having a relatively flat trajectory over a short, effective firing distance such as 9 mm. However, the usefulness of laser sights is substantially diminished when used with weapons that launch a projectile having a large and highly variable trajectory over the effective firing range of the weapon, for example, the mortar. The mortar is, in essence, a muzzle loading cannon that fire shells at low velocities over comparatively short ranges, and at a substantial angular elevation due to the large trajectory of the projectile. The mortar is typically "sighted in" by "guess-timating" the distance to the target, then adjusting the angular elevation after each fired round impacts by again "guess-timating" the distance from the target, until the weapon is finally adjusted so that the fired shell will hit the target. A similar situation is present when attempting to fire a grenade launcher. This procedure is wasteful of ammunition, time consuming, and provides the enemy with sufficient time to respond or retreat. It is well known that an error rate of 20% is considered the norm when firing such weapons.

Laser range finding units have been proposed to provide an accurate means for measuring distance from one location to another. One proposed solution is U.S. Pat. No. 3,464,770, issued to Schmidt on Sep. 2, 1969, which discloses a combined sighting mechanism and laser range finder. In this invention, a laser sends a beam to the target which must be reflected back to a receiver through an elaborate mirror/lens arrangement. The distance to the device is determined by measuring the time interval between emission and reception. Such a device is not practical for installation on a small arm field weapon due to the extraordinary cost of manufacturing and the delicate nature of necessary optics and electronics.

Another invention representative of this genre is U.S. Pat. No. 4,690,550, issued to Kuhne on Sep. 1, 1987, which discloses a laser range finder that has a common telescope for transmitting and receiving the laser signal. Again, the distance to the target is determined by measuring the time interval between emission and reception.

While these devices as well as the numerous others that exist using that principle will accurately and rapidly permit the determination of the distance to a target, the prior art does not disclose a projectile that can be fired from a grenade launcher attached to a rifle or other small arms such as the mortar and, then, can be detonated via a signal sent from the grenade launcher.

SUMMARY OF THE INVENTION

It is an object of the invention to provide a laser detonated projectile apparatus that can be fired from an apparatus that is sufficiently small so that it can be mounted on a rifle.

It is another object of the invention to provide a laser detonated projectile apparatus that can also be fired from standard grenade launchers fitted to standard military rifles such as an M-16.

It is still another object of the invention to provide a laser detonated projectile apparatus that can be detonated by a laser signal from a device that can be carried on small arms such as an M-16.

It is still another object of the invention to provide a laser detonated projectile apparatus that cannot be detonated by dropping or mishandling.

Finally, it is an object of the invention to provide a laser detonated projectile apparatus that can be detonated by a laser signal from a laser guided range finder that has determined the projectile has travelled the targeted distance from the launching site.

DETAILED DESCRIPTION OF THE INVENTION

Figure 1:
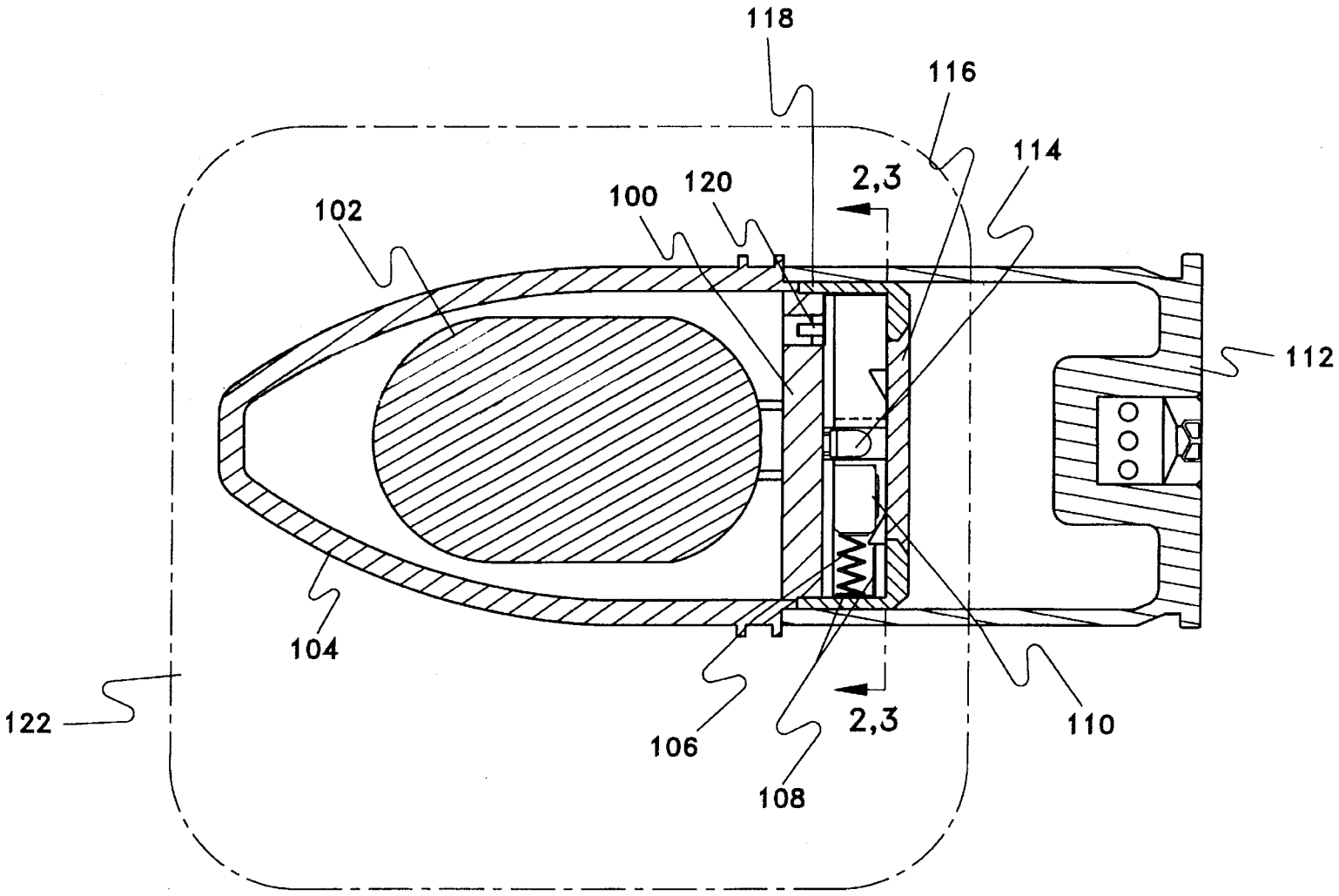
FIG. 1 is a cut-away side of the invention.

FIG. 1 is a cross-sectional side view of the laser detonated projectile 122. This type of ordnance is similar to a standard "203" grenade that is designed to be fired with the M-16. A shaped explosive charge 102 is detonated which causes a plurality of fragments to dispersed from casing 104.

Projectile 122 is shot from a cartridge in the same manner as standard "203" ordnance. A wide angle infrared laser (not shown) attached to a launching apparatus such as disclosed by the inventor in U.S. Pat. application Ser. No. 08/349,375, entitled LASER RANGE FINDING APPARATUS, transmits a laser detonation signal at the point when projectile 122 has reached the desired distance from the point of firing. This distance corresponds to the distance that the range finder had previously determined as being where the target was located. In this manner, projectile 122 can be detonated precisely at the target. It is also possible to detonate projectile 122 above the target so that it would be effective in situations where an enemy was located in foxholes or behind protective barriers.

Circuit board housing 100 contains the electronics necessary to receive the laser signal that is received via infrared detector 114. Detector 114 and its associated electronics can be made, using techniques well known in the art, so that only a particular signal frequency or coded signal will be successful in detonating the device. In that manner, an enemy or extraneous electromagnetic interference cannot cause the device to be detonated until it reaches the target.

Figure 2:
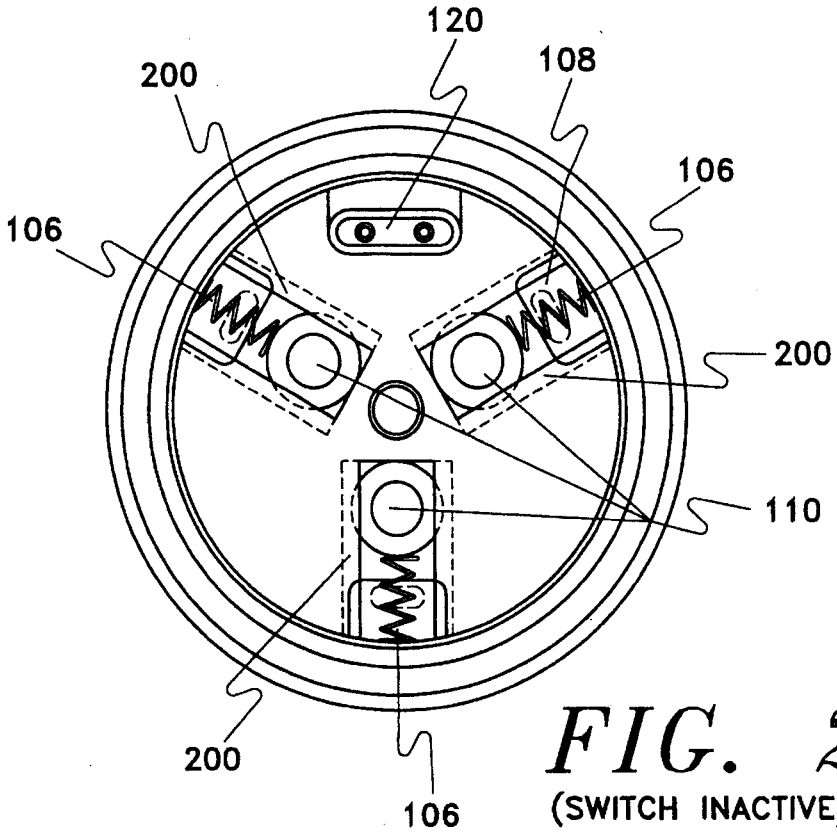
FIG. 2 is a rear cross-sectional view along section line AA of FIG. 1 showing the detail of the battery pack activation mechanism in its inactive state.
Figure 3:
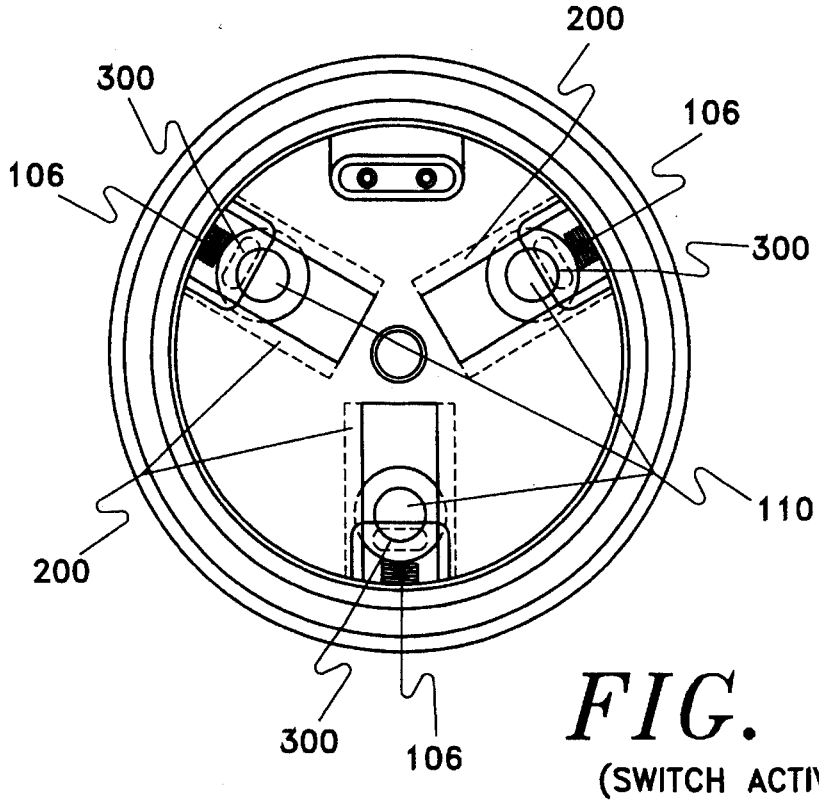
FIG. 3 is a rear cross-sectional view along line AA of FIG. 1 showing the detail of the battery pack activation mechanism in its active state.

As shown, projectile 122 is loaded into a standard 40 mm shell casing 112. Removable IR detector cap 116 protects detector 114 from being fouled with combustion by-products while projectile 122 is being fired. In operation, referring now to FIGS. 2 and 3, the projectile 122 is inactive when the three batteries 110 are urged by springs 106 away from contact points 300 on flexible circuit 108. Flexible circuit 108 is attached to circuit board 100 via pin/socket connector 120. Batteries 110 are preferably 1.5 volt "watch" type of battery sold in jewelry and hardware stores.

After firing, the rifling of the launching tube (not shown) causes projectile 122 to spiral clockwise. Centrifugal force causes batteries 110 to slide in battery track 200 away from the center, that is, away from detector 114. The first point of contact is with tabs of IR detector cover 116. This causes cover 116 to dislodge and fall away. Detector 114 is then exposed and enabled to detect a signal that will be provided by the laser on the launching weapon.

Once all three batteries 110 slide in track 200 and reach flexible circuit 108 ground pads 300, then projectile 122 is powered up and capable of being detonated once the appropriate laser signal is received from the launching source. Unless all three batteries 110 are in place at the same time, projectile 122 cannot be detonated.

Figure 4:
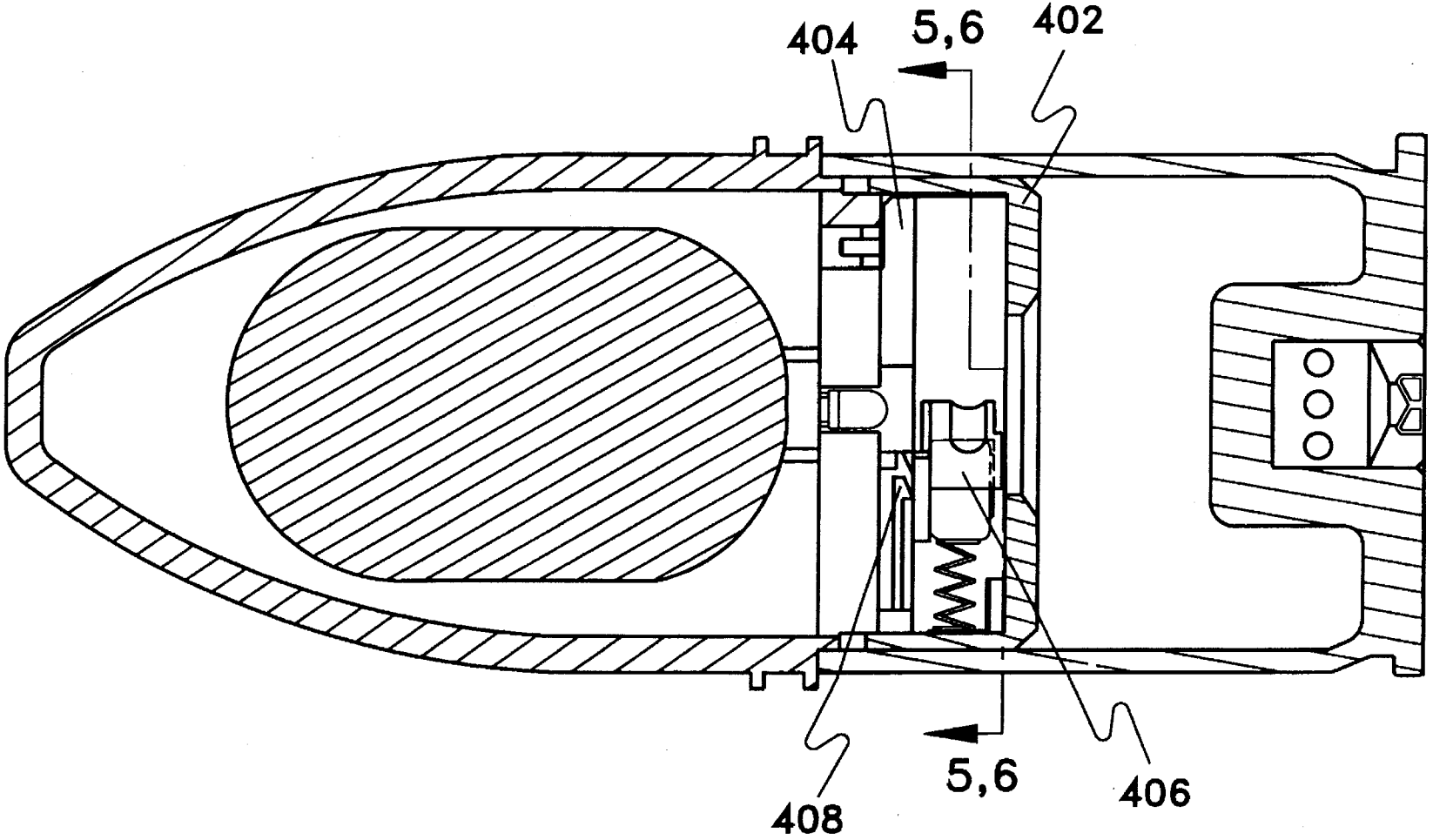
FIG. 4 is cut-away side of an alternative embodiment of the invention.
Figure 5:
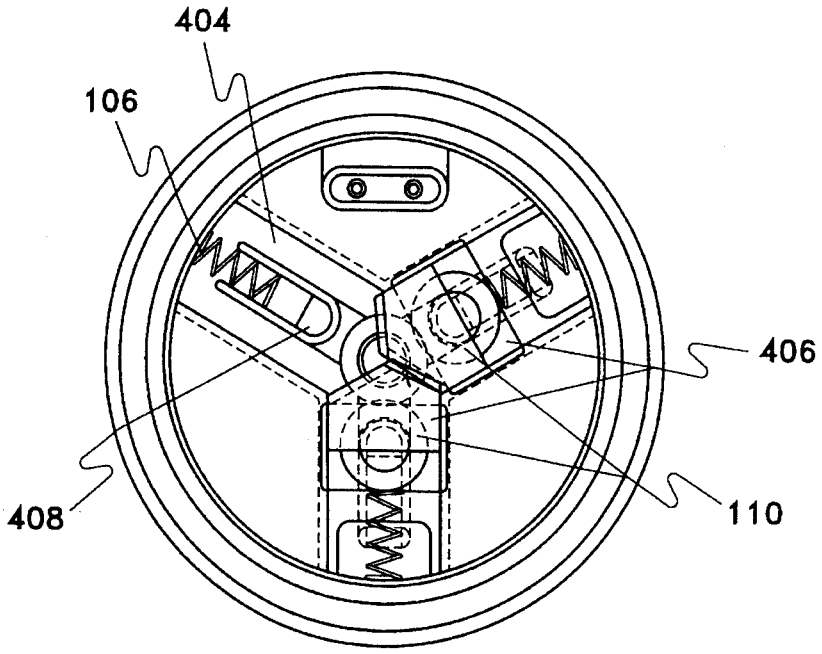
FIG. 5 is a rear cross-sectional view along section line BB of FIG. 4 showing the detail of the battery pack activation mechanism in its inactive state.
Figure 6:
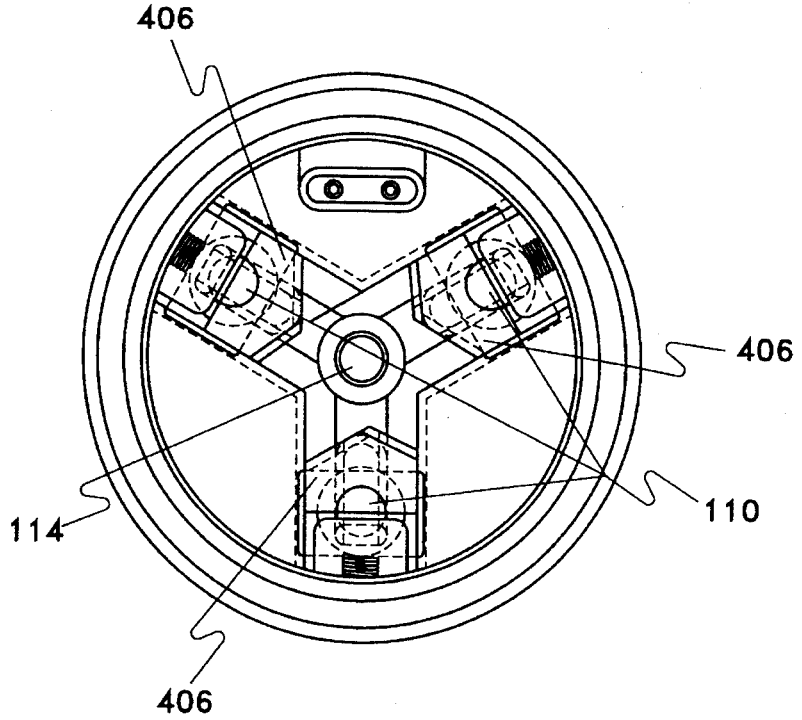
FIG. 6 is a rear cross-sectional view along line BB of FIG. 4 showing the detail of the battery pack activation mechanism in its active state.

Referring now to FIGS. 4–6, an alternative embodiment of the invention is shown. This embodiment is similar except that batteries 104 are placed within battery housings 406. When projectile 122 is in the inactive state, the three battery housings 406 form a protective interlocked cover over the IR detector 114. When fired, battery housings 406 and batteries 104 are forced to the outer most diameter of tracks 200 as noted above. Plate 404 contains 3 clasps 408 that lock battery housings 406 in the open or active position.

Battery housings 406 can be manually opened and locked in projectile 122 if physically removed from casing 112. Once battery housings 406 are manually opened, projectile 122 can then function as a placed charge.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A projectile having an explosive charge that can be detonated at a predetermined range after being fired from a weapon comprising:

cover means for at least partially enclosing a rearward facing portion of said projectile, said cover means adapted to be automatically removed after said projectile has been fired;

detecting means for detecting a predetermined signal that is emitted when said projectile has travelled a predetermined time corresponding to the predetermined range;

central processing means, connected to said detecting means, for processing a signal provided by said detecting means to provide a signal to detonate said explosive charge;

battery power supply means for serving as a safety switch by preventing electrical power from being connected to said central processing means until said projectile has been fired.

2. The projectile of claim 1 wherein said battery power supply means further comprises:

at least one battery and at least one spring, wherein said spring holds said battery in a safe non-contact position until said projectile has begun to spin with sufficient centrifugal force to cause said battery to compress said spring such that said battery can move into an active, contact position, resulting in said projectile capable of being detonated.

3. The projectile of claim 2 further comprising:

detonation means connected to said central process means and said explosive charge, such that when said detecting means detects said predetermined laser signal and feeds said signal to said central processing means, said central processing means sends a detonation signal to said detonation means, powered by said battery supply means, wherein said projectile explodes at the predetermined range.

4. The projectile of claim 3 wherein said signal is an infrared beam emitted from a wide angle infrared laser.

5. The projectile of claim 4 wherein the timing of firing said signal is determined coordinated with a laser range finder.

6. The projectile of claim 2 wherein said battery power supply means further comprises:

a plurality of batteries and a corresponding plurality of springs, such that all of said batteries must compress their corresponding springs such that all batteries must move at substantially the same time from their safe non-contact positions into their active, contact positions, before said projectile is rendered capable of being detonated.

* * * * *